US006699439B1

(12) United States Patent
Dannert et al.

(10) Patent No.: US 6,699,439 B1
(45) Date of Patent: Mar. 2, 2004

(54) STORAGE CONTAINER FOR RADIOACTIVE MATERIAL

(75) Inventors: Volker Dannert, Lingen (DE); Joachim Banck, Heusenstamm (DE); Ernst W. Haas, Buckenhof (DE)

(73) Assignee: Framatome ANP GmbH, Erlangen (DE)

( * ) Notice: Subject to any disclaimer, the term of this patent is extended or adjusted under 35 U.S.C. 154(b) by 704 days.

(21) Appl. No.: 09/093,574

(22) Filed: Jun. 8, 1998

Related U.S. Application Data

(63) Continuation of application No. PCT/EP96/05205, filed on Nov. 25, 1996.

(30) Foreign Application Priority Data

Dec. 7, 1995 (DE) ..... 195 45 761

(51) Int. Cl.[7] ..... G21C 1/00; G21F 9/16

(52) U.S. Cl. ..... 422/159; 422/903; 588/16; 588/18; 264/255

(58) Field of Search ..... 588/16, 4, 9, 1, 588/18, 15, 2; 422/129, 159, 903

(56) References Cited

U.S. PATENT DOCUMENTS 4,778,628 A * 10/1988 Saha et al. ..... 405/128
4,891,164 A * 1/1990 Gaffney et al. ..... 588/19
4,950,426 A * 8/1990 Markowitz et al. ..... 588/9
5,169,566 A * 12/1992 Stucky et al. ..... 264/255

FOREIGN PATENT DOCUMENTS

| | | |
|---|---|---|
| EP | 0 049 936 A1 | 4/1982 |
| EP | 0 245 912 A1 | 11/1987 |
| FR | 0 319 398 A1 | 6/1989 |

OTHER PUBLICATIONS

Excerpt from Ullmann's Encyclopedia of Technical Chemistry, vol. 17 "Molecular Sieve" (Puppe, Dr. L.) In German.

Excerpt from Ullmann's Encyclopedia of Technical Chemistry, vol. 24 "Zeolites" (Mengel, Dr. M.) dated 1983 In German.

Russian Patent Abstract SU 1299369 A1 (Boltenko et al.) dated Jul. 26, 1985.

Japanese Patent Abstract JP63177099 A (Kajima).

* cited by examiner

*Primary Examiner*—Glenn Caldarola
(74) *Attorney, Agent, or Firm*—Laurence A. Greenberg; Werner H. Stemer; Ralph E. Locher

(57) ABSTRACT

Spent fuel rods are stored in a container. In order to improve the retention capacity of the barriers for radioactive emitters (radionuclides), the spent fuel rods are embedded in a bulk fill of zeolite and/or activated charcoal.

12 Claims, 3 Drawing Sheets

STORAGE CONTAINER FOR RADIOACTIVE MATERIAL

CROSS-REFERENCE TO RELATED APPLICATION

This is a continuation of copending international application PCT/EP96/05205, filed Nov. 25, 1996, which designated the United States.

BACKGROUND OF THE INVENTION

1. Field of the Invention

It has been known for a spent nuclear reactor fuel assembly with fuel rods that contain radioactive nuclear fuel in a cladding tube, which represents a tightly enclosed capsule, to be filled with copper granulate among the fuel rods and then to form a container of copper sheet-metal, sealed in gas-tight fashion, around the nuclear reactor fuel assembly at high temperatures and high pressure. The gas-tightly sealed container is placed in a drilled hole in granite at an ultimate storage site, and the hole is filled with bentonite clay as a barrier to radioactive emitters (radionuclides). The copper granulate in the sheet copper container is intended to lend mechanical stability to the container.

2. Summary of the Invention

It is accordingly an object of the invention to provide a container with a radioactive body, which overcomes the disadvantages of the prior art devices and methods of this general type and which is improved with regard to the retention capability of the barriers formed for radioactive emitters (radionuclides). Specifically, it is an object to further improve the radioactive retention of the cladding tubes of the fuel rods and of the container.

With the foregoing and other objects in view there is provided, in accordance with the invention, an ultimate storage container assembly, comprising a gas-tight container, a plurality of spent fuel rods gas-tightly enclosed in the container, and a bulk fill of zeolite and/or activated charcoal embedding the spent fuel rods in the container.

Except for noble gases, zeolite and/or activated charcoal absorb or adsorb nonvolatile or readily volatile radionuclides and thus make it possible to drastically reduce the radioactivity released in the case of a leak in the cladding tubes. This is especially true for radioactive iodine, cesium and strontium. That is, zeolite and/or activated charcoal relieve the barrier function of the container for radioactive emitters (radionuclides).

The bulk fill of zeolite and/or activated charcoal in the container also leaves enough empty space to receive noble gases that are released. Accordingly, excessively high internal pressure cannot build up in the container.

Nevertheless, the bulk fill of zeolite and/or activated charcoal has sufficient thermal conductivity to dissipate the heat of decay, or afterheat, from the fuel rods. The bulk fill also represents additional thermal capacity in the container. The bulk fill, especially if it contains activated charcoal, also has a good moderating effect on neutrons and therefore reduces the hardness of neutron radiation that can be emitted by the radioactive substance in the fuel rods. The bulk fill can also contribute to shielding gamma radiation that originates in the fuel rods. Finally, the bulk fill also acts as a mechanical buffer for the fuel rods supported in the container. These fuel rods are protected by the bulk fill against damage when the container is being transported or manipulated. Radionuclides absorbed by the bulk fill change into states of equilibrium, in response to chemical laws, and thereby lose their tendency to migrate, so that the bulk fill reliably assures long-term storage of the capsules.

In accordance with an added feature of the invention, the container is formed with steel walls and steel plates welded in gas-tight fashion to the steel walls.

In accordance with another feature of the invention, a fuel assembly encloses the fuel rods and the fuel assembly is penetrated by the bulk fill. The container may be dimensioned to house a single the fuel assembly.

In accordance with an additional feature of the invention, the bulk fill is formed of granulate material.

Furthermore, additional bulk fill selected from the group consisting of zeolite and activated charcoal may surround the container.

In accordance with a further feature of the invention, the zeolite is type A zeolite, preferably selected from the group consisting of MgA, CaA, and SrA. Further, the zeolite may be doped with silver.

Preferred zeolites are chabazite and mordenite.

In accordance with a concomitant feature of the invention, particles are admixed in the bulk fill, the particles being selected from the group consisting of metal grit, $MnO_2$, $Al_2O_3$, MgO, $SnO_2$, $ZrO_2$, and silicate.

Other features which are considered as characteristic for the invention are set forth in the appended claims.

Although the invention is illustrated and described herein as embodied in a container with a radioactive body, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
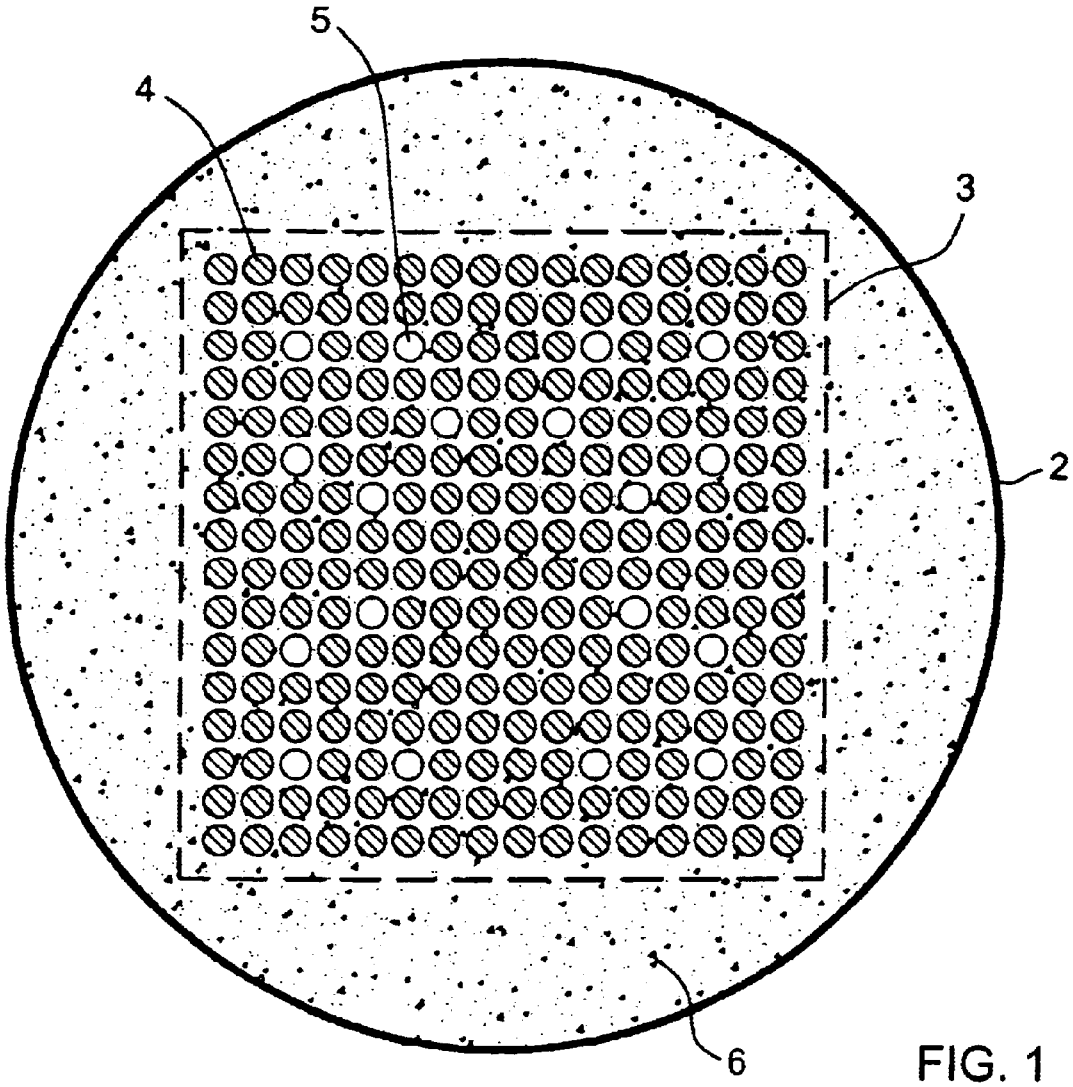
FIG. 1 is a schematic cross section through a transport and/or storage container with an irradiated nuclear reactor fuel assembly.

Referring now to the figures of the drawing in detail and first, particularly, to FIG. 1 thereof, there is seen a nuclear reactor fuel assembly 3 in an elongated storage container 2. The square outline of the nuclear reactor fuel assembly 3 is suggested by dashed lines. The nuclear reactor fuel assembly 3 has fuel rods 4 and guide tubes 5. The fuel rods 4 are filled with spent nuclear fuel, such as $UO_2$ and/or $U/PuO_2$, which contains radionuclides. The nuclear fuel is located in each case on a cladding tube of the fuel rods 4 which for instance comprises a zirconium alloy sealed with a plug of zirconium alloy on each of the two ends of the tube. These zirconium allow plugs are welded in gas-tight fashion to the cladding tube. The guide tubes 5 served to guide control rods and are open on at least one end. They do not contain any radionuclides. The storage container 2 is filled with a bulk fill 6 of zeolite granulate. The bulk fill 6 need not be compacted, and the spaces around the fuel rods 4 and hence necessarily the guide tubes 5 of the nuclear reactor fuel assembly 3 are also filled with it. The container 2 comprises steel and is welded in gas-tight fashion to a steel plate on both ends.

Figure 2:
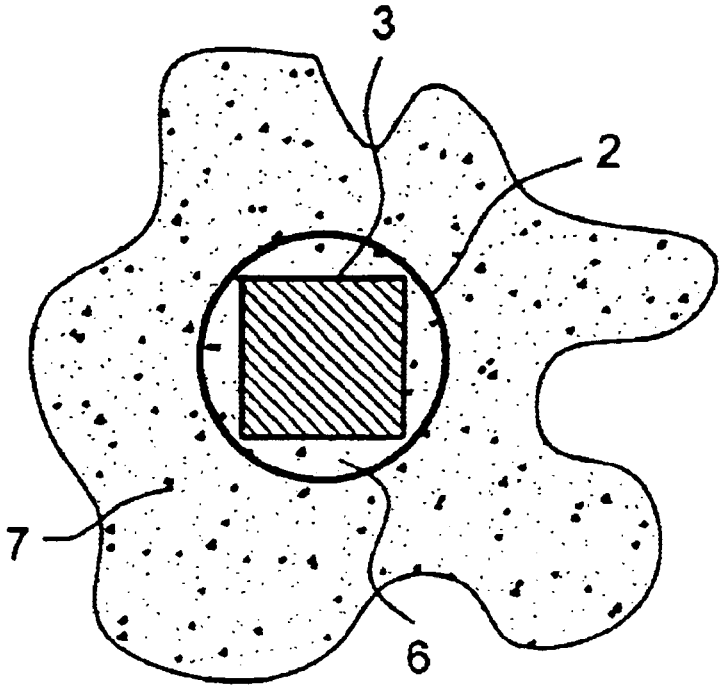
FIG. 2 is a partial schematic cross-sectional view of the storage container of FIG. 1 in an ultimate storage site.

Referring now to FIG. 2, the container 2 that contains the nuclear reactor fuel assembly 3 with the spent fuel rods is inserted into a bore, located for instance in a salt dome of an ultimate storage site. Also located in this bore on the outside of the container 2 is a further bulk fill 7, once again a zeolite granulate. The container 2 is completely embedded in the bulk fill 7.

Activated charcoal can also be admixed with the bulk fills 6 and 7 of zeolite in FIGS. 1 and 2. With regard to zeolites, reference is had to Ullmanns "Enzyklopädie der Technischen Chemie" [Ullmann's Encyclopedia of Industrial Chemistry], vol. 24, pp. 575–578, 1983, and Ullmanns "Enzyklopädie der Technischen Chemie", vol. 17, pp. 9–17, 1979. Zeolite type A, preferably of at least one of the substances in the group comprising MgA, CaA and SrA, is especially suitable for the bulk fills 6 and 7. Type A zeolite of this kind can also be doped with silver, rendering it especially suitable at trapping radioactive iodine that might possibly escape from a leak in the cladding tube of a fuel rod 4 but is then already trapped in front of the wall of the container 2, whose retention action is accordingly still further increased by the zeolite of the bulk fill 6 in the container 2. Chabazite and mordenite are also well-suited as zeolite bulk fills. For example, zeolites with the tradename "Zeolon Molecular Sieves" of the 400 Series, 500 Series, 700 Series and 900 Series, which bind via an ion exchange of Cs and Sr, are especially highly suitable.

Particles of at least one of the substances in the group comprising metal grit, $MnO_2$, $Al_2O_3$, MgO, $SuO_2$, $ZrO_2$ and silicate, which are admixed with at least one of the bulk fills 6 and 7, increase the thermal conductivity of these bulk fills 6 and 7 in order to dissipate the afterheat of the fuel rods 4.

Figure 3:
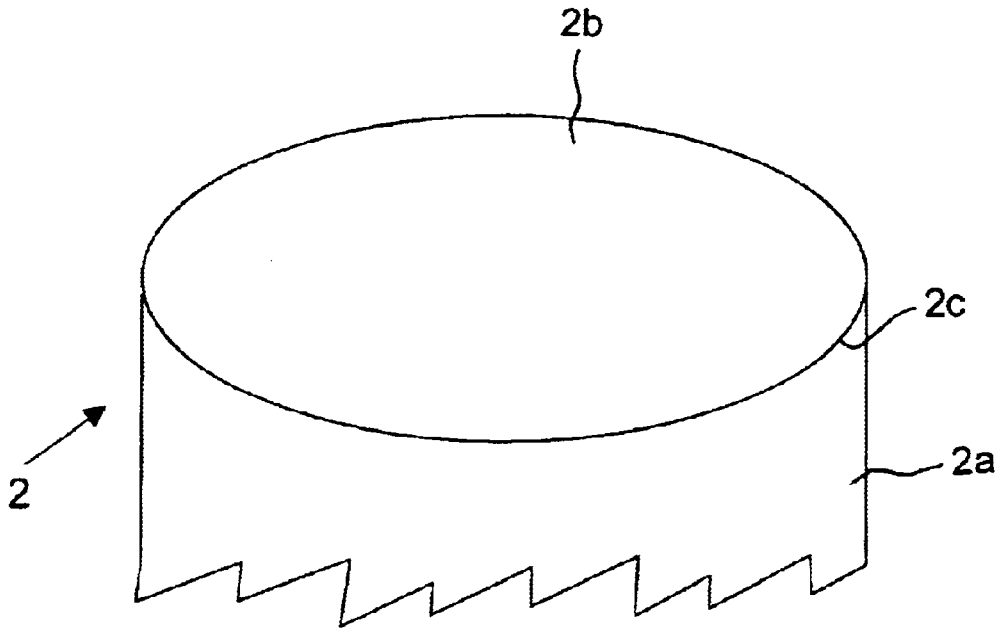
FIG. 3 is a partial perspective view of the container with a steel plate closing an opening.

Referring now to FIG. 3, the container 2 is formed from a suitable steel with steel walls 2*a* and steel plates 2*b* closing off the ends. The steel plates 2*b* are tightly welded to the steel walls 2*a* at weld seams 2*c*.

We claim:

1. An ultimate storage container assembly, comprising a gas-tight container, an arrangement of a plurality of spent fuel rods and spaces between said fuel rods, said arrangement being gas-tightly enclosed in said container, and a bulk fill selected from the group consisting of zeolite and activated charcoal embedding said spent fuel rods in said container, said bulk fill penetrating said spaces.

2. The container assembly according to claim 1, which further comprises a fuel assembly enclosing said fuel rods and being penetrated by said bulk fill.

3. The container assembly according to claim 2, wherein said container is dimensioned to house only a single said fuel assembly.

4. The container assembly according to claim 1, wherein said bulk fill is formed of granulate material.

5. The container assembly according to claim 1, which further comprises a further bulk fill selected from the group consisting of zeolite and activated charcoal surrounding said container.

6. The container assembly according to claim 1, wherein said zeolite is A type zeolite.

7. The container assembly according to claim 6, wherein said zeolite is formed from at least one substance selected from the group consisting of MgA, CaA, and SrA.

8. The container assembly according to claim 7, wherein said zeolite is doped with silver.

9. The container assembly according to claim 6, wherein said zeolite is doped with silver.

10. The container assembly according to claim 1, wherein said zeolite is selected from the group consisting of chabazite and mordenite.

11. The container assembly according to claim 1, which further comprises particles of at least one substance selected from the group consisting of metal grit, $MnO_2$, $Al_2O_3$, MgO, $SnO_2$, $ZrO_2$, and silicate admixed with said bulk fill.

12. An ultimate storage container assembly, comprising a gas-tight container, an arrangement of a plurality of spent fuel rods and spaces therebetween, said arrangement being gas-tightly enclosed in said container, and a bulk fill selected from the group consisting of zeolite and activated charcoal embedding said spent fuel rods in said container and penetrating said spaces, said container being formed with steel walls and steel plates welded in gas-tight fashion to said steel walls.

* * * * *